United States Patent [19]

Srivastava

[11] Patent Number: 4,973,840

[45] Date of Patent: Nov. 27, 1990

[54] APPARATUS AND METHOD FOR CHARACTERIZING THE TRANSMISSION EFFICIENCY OF A MASS SPECTROMETER

[75] Inventor: Santosh K. Srivastava, La Canada, Calif.

[73] Assignee: The United States of America as represented by the Administrator of the National Aeronautics and Space Administration, Washington, D.C.

[21] Appl. No.: 358,027

[22] Filed: May 26, 1989

[51] Int. Cl.[5] ..... H01J 49/40

[52] U.S. Cl. ..... 250/281; 250/282; 250/286; 250/287; 250/288; 250/305; 250/423 R; 250/427

[58] Field of Search ..... 250/281, 282, 283, 309, 250/427, 288, 423 R, 286, 287, 299, 300, 305

[56] References Cited

U.S. PATENT DOCUMENTS

| | | | |
|---|---|---|---|
| 2,764,691 | 9/1956 | Hipple, Jr. | 250/287 |
| 2,765,408 | 10/1956 | Wiley et al. | 250/287 |
| 2,947,868 | 8/1960 | Herzog | 250/309 |
| 3,307,033 | 2/1967 | Vestal | 150/287 |
| 3,435,207 | 3/1969 | Baldwin | 250/287 |
| 3,522,430 | 8/1970 | Jenckel | 250/427 |
| 3,582,648 | 6/1971 | Anderson et al. | 250/287 |
| 3,668,384 | 6/1972 | Moorman et al. | 250/427 |
| 3,673,404 | 6/1972 | Major, Jr. | 250/282 |
| 3,727,047 | 4/1973 | Janes | 250/283 |
| 3,769,513 | 10/1973 | Delany | 250/283 |
| 3,953,732 | 4/1976 | Oron et al. | 250/287 |
| 4,158,775 | 6/1979 | Chutjian et al. | 250/282 |
| 4,215,411 | 7/1980 | Franzen | 364/527 |
| 4,377,745 | 3/1983 | Chang | 250/283 |
| 4,472,631 | 9/1984 | Enke et al. | 250/281 |

OTHER PUBLICATIONS

Thomas Ehlert, "Determination of Transmission Characteristics in Mass Filters," Journal of Physics E: Scientific Instruments, vol. 1, pp. 237–239 (1970).

O. J. Orient & S. K. Srivastava, "Production of Negative Ions by Dissociative Electron Attachment to $SO_2$," Journal of Chemical Physics, vol. 78(6), Part I, pp. 2949–2952, Mar. 15, 1983.

E. Krishnakumar & S. Srivastava, "Ionization Cross Sections of Rare Gas Atoms by Electron Impact," Journal of Physics B: Atomic Molecular and Optical Physics, vol. 21, pp. 1055–1082 (1988).

*Primary Examiner*—Jack I. Berman
*Assistant Examiner*—Kiet T. Nguyen
*Attorney, Agent, or Firm*—Thomas H. Jones; John R. Manning

[57] ABSTRACT

An electron/ion coincidence technique is employed to characterize the absolute mass dependent transmission efficiency of mass spectrometers. The technique is not dependent upon the partial pressure of the sample beam or the ionization cross sections of calibrant gases.

10 Claims, 2 Drawing Sheets

APPARATUS AND METHOD FOR CHARACTERIZING THE TRANSMISSION EFFICIENCY OF A MASS SPECTROMETER

ORIGIN OF THE INVENTION

The invention described herein was made in the performance of work under a NASA contract, and is subject to the provisions of Public Law 96-517 (35 USC 202) in which the Contractor has elected not to retain title.

TECHNICAL FIELD

The invention relates to mass spectrometry. More particularly, the invention relates to an apparatus and a method for measuring the mass dependent transmission efficiency of a mass spectrometer.

BACKGROUND ART

A mass spectrometer is an analytical device which employs magnetic and/or electrical fields for separating charged particles according to the mass and charge of the particle. The sample material is usually a gas or volatile substance. The sample material is passed at low pressure into the mass spectrometer where it is ionized. Ionization may be accomplished by means of bombardment with a beam of electrons. The energy of the electron beam may be selected to optimize the production of ions having a single positive charge. Ionization can also lead to fragmentation of the sample material. The resulting assortment of ions and ion fragments is then further processed by the mass spectrometer.

The newly created sample ions are accelerated by means of an electric field. The sample ions are then collimated by passage through a series of aligned apertures. The last aperture opens into the mass filter. Once inside the mass filter, sample ions are carried forward by their kinetic energy. However, the trajectories of the sample ions are modified by interactions with the magnetic and/or electric fields which characterize the mass filter. The sample ions are then detected and/or counted as they exit from the mass filter. Often there is an exit slit between the mass filter and the detection means for detecting ions. The exit slit enhances the resolution of the mass spectrum. The resulting mass spectrum consists of a display of the various masses detected and their relative abundances.

The magnetic and/or electric fields of the mass filter may assume a number of configurations. The mass filter may employ a simple magnetic sector with a field perpendicular to the flight path of the sample ions. The trajectory of sample ions traversing the magnetic sector curves according to the mass and velocity of the ion. If good resolution is desired with this type of mass filter, a comparatively large magnet must be employed.

If it is desired to use a relative small magnet while retaining good range and resolution, a cycloidal mass filter may be employed. The cycloidal mass filter employs crossed magnetic and electric fields. The use of crossed magnetic and electric fields reduces the radius of curvature of the trajectory of sample ions as compared to the simple magnetic sector mass filter. Accordingly, a relatively small magnet may be employed with the cycloidal mass filter without sacrificing range or resolution.

On the other hand, if the sample ions have a broad band of kinetic energy, the resolution of the mass spectrometer may by reduced. To correct for situations where there is a broad band of kinetic energy, a Mattauch-Herzog double focusing mass filter may be employed. The Mattauch-Herzog double focusing mass filter employs an initial electrostatic separator for separating ions according to velocity. The sample ions which have passed through the electrostatic separator may then pass through a second set of entry slits which lead to a magnetic separator for separating ions according to mass.

Recently, mass spectrometers have been developed which employ quadrature mass filters. Quadrupole mass filters have an analyzer tube with a four electrode system having both RF and DC voltages. Stable ion trajectories are obtained through the mass filter only if there is a proper relationship between the kinetic energy of the ion and applied RF and DC voltages. Unstable trajectories do not exit from the mass filter. Because the quadrupole mass filter lacks a magnet, it is relatively light and compact and can be scanned relatively quickly. However, the transmission efficiency of the quadrupole mass filter is highly mass dependent.

Employing a time-of-flight method eliminates the need for both a magnetic and an electric field. If the sample ions have uniform kinetic energy and if their entry into the mass filter is pulsed, their exit will also be pulsed, except that ions having different mass will traverse the mass filter with different times of flight. Hence, the output of the ion detector at the exit of the mass filter produces a complete scan of the mass spectrum with each pulse.

Numerous other mass filters applying a variety of separation techniques have been employed. Each mass filter has its advantages and disadvantages. Transmission efficiency of ions through a mass filter to a detector is one characteristic by which all of these various mass filters may be compared.

The absolute transmission efficiency is defined as $I/I_0$, where $I_0$ is the number of ions entering the mass spectrometer and I is the number of ions exiting the mass spectrometer, where the mass spectrometer includes all apparatus between the point where an ion is created and the point at the ion detector positioned at the output of the mass filter. A number of factors determine the transmission efficiency. The transmission efficiency is greatly influenced by such factors as instrument geometry and the charge and energy distributions of the sample ions. For example, if both the ingress and egress apertures of the mass filter are relatively wide, the transmission efficiency will be relatively high and the resolution will be relatively low; if both the ingress and egress apertures of the mass filter are relatively narrow, the transmission efficiency will be relatively low and the resolution will be relatively high. Well engineered mass spectrometers will have high values for both the resolution and the transmission efficiency.

Tranmission efficiency may also be mass dependent. For example, the transmission efficiency of the quadrupole filter is highly mass dependent. Such mass filters are sometimes described as discriminating. However, other mass filters, such as the magnetic sector filters, can be designed to have transmission efficiencies which are relatively insensitive to the mass of the sample ions over a broad range. If the transmission efficiency of a mass filter is mass dependent and if the mass filter is to be employed for quantitative measurements, it is essential to know its mass dependent transmission efficiency with some accuracy. Quantitative mass spectroscopy is particularly important when analyzing the chemistry or physics of the ionization process itself.

A method for measuring the relative mass dependent transmission efficiency of mass spectrometers was described by Thomas Ehlert in the *Journal of Physics E: Scientific Instruments,* Vol. 1, pages 237–239 (1970), "Determination of Transmission Characteristics in Mass Filters." Ehlert's method employs calibrant gases having known isotopic abundances applied at steady partial pressures. Ehlert employed his method to characterize the relative mass dependent transmission efficiency of a quadrupole filter. A modification of Ehlert's method was described and employed by O. J. Orient and S. K. Srivastava for measuring the dissociative electron attachment cross sections for various ion fragments of $SO_2$. *Journal of Chemical Physics,* Vol. 78(6), Part I, pages 2949–2952, 15 Mar. 1983, "Production of Negative Ions by Dissociative Electron Attachment to $SO_2$."

An alternative method for measuring the mass dependent transmission efficiency of mass filters was described by E. Krishnakumar and S. L. Srivastava in the *Journal of Physics B: Atomic Molecular and Optical Physics,* Vol. 21, pages 1055–1082 (1988), "Ionization Cross Sections of Rare Gas Atoms by Electron Impact." That reference describes a method for measuring the ionization cross sections of gases. The measured ionization cross sections of such gases are then employed for calibrating the transmission efficiency of a mass filter.

The prior-art methods for measuring the transmission efficiency of a mass spectrometer require a knowledge of the electron beam current and either the ionization cross section of calibrant gases or the partial pressure of the unionized sample beam of the calibrant gases. Obtaining this data for calibrant gases and applying these prior-art methods may be difficult and susceptible to error in some cases. What is needed is a simple method and apparatus for determining the absolute transmission efficiency of a mass filter without any knowledge of the electron beam current, the ionization cross section of the calibrant gases and the partial pressure of the unionized sample beam of the calibrant gases.

STATEMENT OF THE INVENTION

Accordingly, it is an object of the invention to provide an apparatus and method for measuring the transmission efficiency of a mass spectrometer using an electron/ion coincidence technique. The invention teaches that the transmission efficiency of a mass spectrometer may be obtained by first counting a subset of ions as they are created and comparing this first count, $I_0$, with a second count, I, which consists of the same subset of ions as they exit from the mass filter. The second count includes only those ions which are time correlated with ions includes in the first count. The absolute transmission efficiency is then given by $I/I_0$.

The first count $I_0$ is produced indirectly by counting a subset of electrons from an electron beam which collide with sample molecules to cause their ionization. It is preferred to employ an electron beam having electrons of substantially uniform energy $E_1$ to ionize the sample material, where the energy $E_1$ exceeds the energy of ionization of the sample material. Each ionization event causes one electron from the electron beam to lose an energy equivalent to the energy of ionization. Accordingly, an electron which causes an ionization event will lose an energy equivalent to the energy of ionization for the particular sample material. Such electrons will have a substantially uniform energy $E_2$, where the energy $E_2$ is equal to the difference between the energy $E_1$ and the energy of ionization of the sample material. The apparatus of the invention employs an electron energy analyzer to filter out electrons having an energy other than the energy $E_2$. After passing through the electron energy analyzer, the electrons having energy $E_2$ strike and activate charged particle (electron) detector and are counted. The count of a subset of these electrons substantially corresponds to a count of a subset of sample ions created by collisions with the electrons of this subset.

The second count I is produced by detecting ions which exit from the mass filter. However, only ions which are time correlated with electrons detected within the first count are included in the second count. The quotient of the second count and the first count is a measure of the transmission efficiency of the mass filter.

The invention encompasses the method and apparatus for counting a subset of electrons of energy $E_2$ which have caused the ionization of sample material, correlating these electrons with a subset of ions which exit from the mass filter and counting such correlated ions for determining the transmission effciency of the mass filter.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
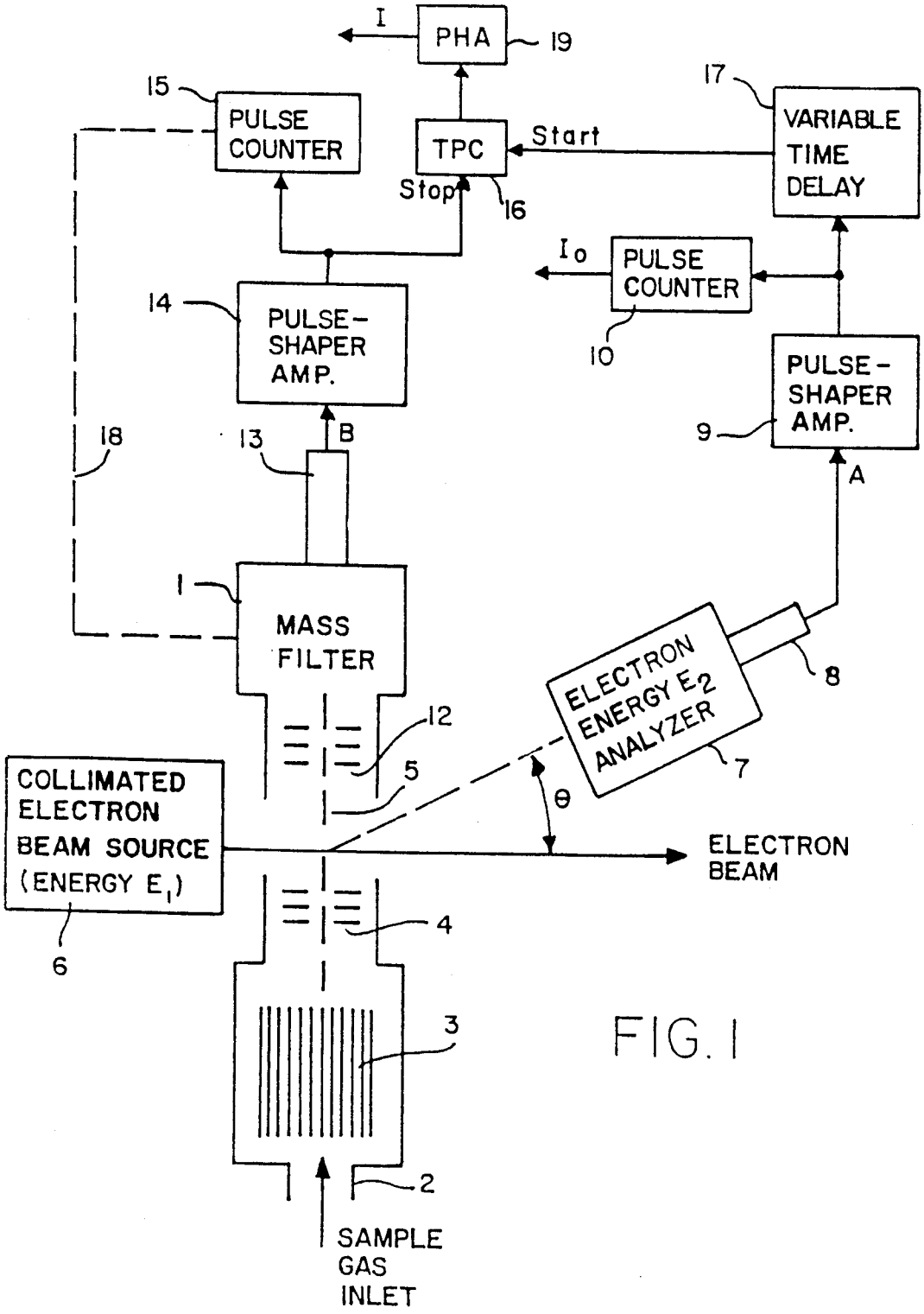
FIG. 1 illustrates schematically a mass spectrometer with apparatus for measuring the transmission efficiency of a mass filter in the spectrometer in accordance with the present invention.

Referring to FIG. 1 of the drawings to measure the transmission efficiency of a mass spectrometer comprised in part of a mass filter 1 in a vacuum chamber (not shown), the method of the present invention uses an electron/ion coincidence technique. Measurement of the transmission efficiency of a mass spectrometer may be performed alone or may be performed in conjunction with measurements of sample transmission through the mass spectrometer. However, the electron/ion coincidence technique described herein relies on the use of particle counting techniques for counting sample ions. Accordingly, if transmission and transmission efficiency are to be measured simultaneously, it is preferred that the transmission measurements also employ particle counting for measuring ion flux. Measurements of sample transmission through a mass spectrometer using a particle counter may be performed according to the following conventional steps:

1. passing the sample material into the vacuum of the apparatus;
2. ionizing the sample material;
3. accelerating the ionized sample material;
4. collimating the accelerated ions;
5. separating the accelerated ions by means of the mass filter; and 6. detecting and counting of the separated ions by means of a particle counter.

The transmission efficiency of the mass spectrometer is a measure of the efficiency of the acceleration, collimation, separation, and detection steps. The transmission efficiency is defined as $I/I_0$, where $I_0$ is a measure of the ions created during the ionization step and I is a measure of the ions which are detected after the separation step. Transmission losses may occur at any step between acceleration and detection. However, mass filters, such as the quadrupole mass filter, are particularly mass dependent with respect to their transmission efficiency.

The mass spectrometer may employ any conventional method for passing sample material into the vacuum chamber of the apparatus. In a preferred mode, the sample material is gaseous or volatile and is passed into the apparatus through a gas inlet 2, although a solid sample may be operated upon to produce ions by electron bombardment. Since the apparatus is evacuated, the sample material will flow into the apparatus due to the pressure drop. The gas inlet 2 of this preferred mode may then lead to a capillary array 3 which controls the flow rate of the sample material and maintains a flow rate corresponding to molecular or viscous flow. After passing through the capillary array 3, the sample material may be collimated by means of apertures or slits in three or more baffles 4 in order to form a well-defined sample beam 5. The sample beam is then passed into an area where it is ionized by collision with a collimated electron beam from a source 6. The method of the invention does not require a precise knowledge of the partial pressure of the gas at the point of collision with the electron beam.

The energy of the electron beam should be greater than the ionization energy of the sample material. The electron beam may be generated using an electron gun having a filament for releasing electrons and electrodes for attracting, accelerating and focusing the released electrons, as described by Krishnakumar and Srivastava (1988) cited above. The energy of the electron beam is determined by the bias between the filament and the electrodes. Additionally, the energy spread of the electron beam should be as small as possible so as to reduce the noise and error of the measurement discussed below. An energy spread of the electron beam of less then 300 mV produces good results. It should be pointed out that the method of the invention does not require a precise knowledge of the electron beam current.

In the preferred mode, the axis of the electron beam is normal to the path of the sample beam 5 at the point of collision. Many of the electrons from the electron beam will pass through the sample beam 5 without colliding and without losing any of their energy. However, many of the electrons will collide with sample molecules. Some collisions will result in the scattering of the electron and the transfer of energy from the electron to the sample molecule but will not result in the ionization of the sample molecule. In such cases, the energy of the scattered electron will be reduced by an amount less than the ionization energy of the sample molecule. However, a portion of the collisions between the sample beam 5 and the electrons of the electron beam will result in the production of positive ions from the sample material.

The frequency of ionization events is related to the ionization cross section of the sample material. However, it should be pointed out that the method of the invention does not require a precise knowledge of the ionization cross section fo the sample material. Colliding electrons will have lost energy equivalent to the energy of ionization. If the electrons of the electron beam have a uniform energy of $E_1$, then the colliding electrons which cause an ionization event will have an energy $E_2$, where energy $E_2$ equals energy $E_1$ minus the energy of ionization of the sample molecules.

The production of one positive ion corresponds to the production of two free electrons. One of the electrons is released from the sample molecule upon impact with the electron beam. This first electron usually has a relatively low energy. The other free electron is scattered from the electron beam upon impact with the sample beam 5. This second electron has a substantially uniform energy of $E_2$, as dicussed above. Other electrons, which are scattered from the electron beam but which do not correspond to an ionization event, have an energy greater then $E_2$. Hence, the count of all electrons of energy $E_2$ is a count of all ionization events. Electrons of energy $E_2$ may be scattered at all angles with respect to the axis of the electron beam, including the zero angle.

A measure of the number of ionization events may be obtained by counting the electrons of energy $E_2$ resulting from the collision of electrons with the sample beam 5. In order to count the number of electrons of energy $E_2$, a solid angle of the scattered electrons are passed through an electron energy analyzer 7. A preferred electron energy analyzer 7 is the trochoidal analyzer. The trochoidal analyzer allows the counting of electrons which have the specific energy $E_2$ and which are scattered at zero angle. The zero angle includes the greatest number of electrons which have not collided with same beam 5 and which have not been de-energized. Additionally, the number of electrons which are scattered at zero angle may be relatively fewer than the number of electrons scattered at other solid angles. Accordingly, the trochoidal analyzer needs to be relatively more efficient at filtering out electrons having an energy other than $E_2$. However, under certain circumstances, constraints with respect to weight and design may require that the electrons of energy $E_2$ be detected at the angle zero and, under these circumstances, use of the trochoidal analyzer is preferred.

Electron energy analyzers 7, which may be employed at solid angles other than the zero angle, include the hemispherical electron energy analyzer, the cylindrical electron energy analyzer, the parallel plate electron energy analyzer and the Wein filter. Any of these electron energy analyzers 7 may be placed in the path of the scattered electrons for filtering out electrons having an energy other than $E_2$.

After electrons of energy $E_2$ have passed through the electron energy analyzer 7, they impinge upon an electron detector 8. The pulse signal from the electron detector 8, referred to in the claims as a pulse signal A, is shaped and amplified by a pulse-shaped amplifier 9 referred to simply as amplifier A in the claims. Each pulse signal A from the pulse shaped amplified 9 corresponds to the detection of one electron of energy $E_2$, which in turn corresponds to the production of one positive ion from the sample beam 5. The output of the pulse-shaper amplifier 9 is connected to a pulse counter 10 where pulses are counted over a period of time. In the claims, pulse counter 10 is referred to as pulse counter A.

It is unnecessary to count all electrons of energy $E_2$. The counted electrons form a subset of all electrons of energy $E_2$. This subset $I_0$, i.e., the set of counted electrons, is time correlated with ions which exit from the mass filter 1 as discussed below. Only ions which are time correlated with subset $I_0$ are themselves counted. Accordingly, the method of this invention does not require a precise knowledge of the value of the transmission efficiency of the electron energy analyzer 7. Furthermore, since electrons having energy $E_2$ are scattered at random angles from the electron beam axis, the electron energy analyzer 7 and detector 8 may be placed and oriented at any arbitrary angle $\theta$ with respect to the electron beam 6 in order to detect these scattered electrons $E_2$. However, it is often desirable to maximize the transmission efficiency of the electron energy analyzer 7 and to optimize the angle $\theta$ so as to receive the greatest number of scattered electrons.

After the sample beam 5 has been impacted by electrons of the electron beam 6 and ionized, the resultant ions are accelerated by means of a conventional ion accelerator and collimator 12.

The mass filter 1 is employed for separating ions according to their mass. Mass filters are conventional in the field of mass spectrometry. Prior-art mass filters are discussed above in the background section. The separated ion particles exit from the mass filter 1 and are detected by a charged particle (ion) detector 13 as they exit from the mass filter 1. The detection of each ion results in the output of a pulse signal, referred to as pulse signal B within the claims. Pulse signal B is shaped and amplified by a pluse-shaper amplifier 14. If it is desired to measure the transmission of the sample ions, the amplified pulse signal B may be counted by a counter 15. A Channeltron particle counter is preferred for counting separated sample ions. Note that to produce a mass spectrum, the pulse counter 15 must be reset to zero upon adjusting the mass filter 1 to a different particle mass to be filtered. This coordinated setting control is indicated by a dashed line 18 in the drawing connecting those elements.

Figure 2A:
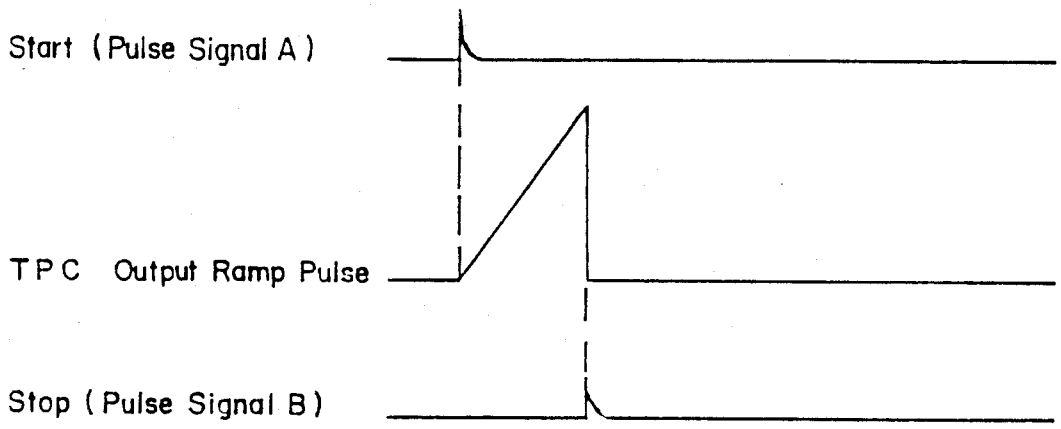
FIGS. 2*a* and 2*b* illustrate timing diagrams useful in understanding a feature of the present invention.

A time-to-pulse-height converter (TPC) 16 is employed for counting the subset of separated ions which are time correlated with counted electrons of energy $E_2$. A preferred TPC is supplied by EG&G Ortec of Oakridge, Tenn., model #567 (TAC/SCA). This subset is referred to as subset I within the claims. In one mode, the TPC 16 is initiated directly by an amplified pulse signal A from the electron detector 8 and is stopped by an amplified pulse signal B from the ion detector 13. The timing diagram shown in FIG. 2*a* illustrates this mode. A pulse signal A starts a ramp generator in the TPC, and a pulse signal B stops the ramp generator and resets the ramp generator. The result is a pulse emitted for each pair of electrons and ion pulse signals A and B by the TPC 16 which is tuned to produce an output pulse of predetermined height when the length of time between the start signal and the stop signal substantially corresponds to the time of flight of the ion through the mass filter 1. Tuning is accomplished by adjusting the slope of the ramp generator in the TPC. A pulse height analyzer PHA 19 detects and counts output pulses which correspond to the detection of elements of the subset I, i.e., the separated ions which are time correlated with counted electrons of energy $E_2$ that lie within subset $I_0$. A preferred PHA is supplied by EG&G Ortec of Oakridge, Tenn., model #530 (EG&G/Norland). A second subset of pulse signals B, which are not time correlated with the subset $I_0$, are treated as background signal.

Figure 2B:
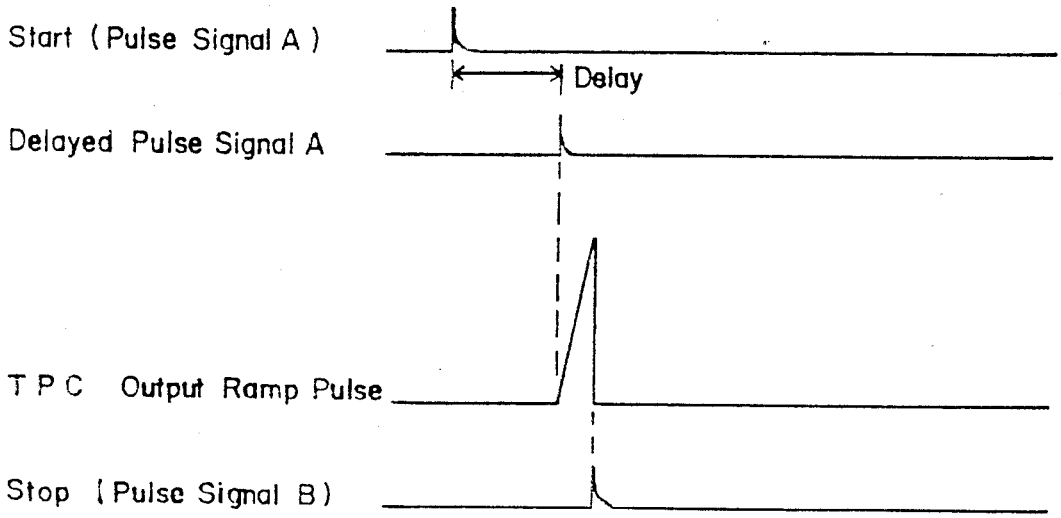

In a preferred mode, a variable time delay device 17 is employed to initiate operation of the TPC in order to be able to prevent pile up within the TPC. Pile up occurs when there are too many collisions of electrons with the sample, i.e., when the sample is too rich with particles to be ionized. In order to process correlated pairs of electrons and ions more rapidly, it is possible to delay the electron signal pulse, as shown in FIG. 2*b* and increase the slope of the ramp to be generated, or decrease the height to be used as a criterion for the pulse height analyzer and counter 19. FIG. 2*b* illustrates increasing the slope as the preferred mode, which may be readily accomplished by merely increasing the gain of an output amplifier of the TPC. Thus, instead of feeding the output of the electron detector 8 directly to the TPC 16 from the pulse shaper amplifier 9, the output of the pulse shaper amplifier 9 is first applied to the variable time delay device 17, the output of which is then supplied to the TPC. The output of the variable time delay device 17 is substantially identical to its input except that the output is delayed with respect to the input. The length of the delay is variable. In the preferred mode, the length of the delay is adjusted so that it is slightly less than the time of flight of the ion through the mass filter 1. Interposing the variable time delay device 17 between the electron detector 8 and the TPC, and adjusting the length of delay to correspond to a time slightly less than the time of flight through the mass spectrometer, thus prevents pile up within the TPC and improves its efficiency.

The output of the TPC corresponding to the subset I is then supplied to the pulse height analyzer and counter 19 which counts the subset I, i.e., the number of ions which are time correlated with counted electrons of energy $E_2$ in subset $I_0$. This correlation is effected by accepting pulses out of the TPC that are of the predetermined height, plus and minus some tolerance.

For any given time interval, the quotient of the count of the subset I of the time correlated ions of mass M and the count of the subset $I_0$ of electrons of energy $E_2$ is a measure of the transmission efficiency of the mass filter with respect to mass M.

The method of the invention may employ several calibrant gases of differing masses to calibrate the transmission efficiency of a mass spectrometer. The transmission efficiency of the instrument with respect to sample materials is then estimated by interpolation with respect to the calibrant gases. However, the transmission efficiency of the mass spectrometer may also be determined for each sample material directly by the method of the invention. In the claims, the term sample material includes calibrant gas.

I claim:

1. An apparatus for determining the transmission efficiency of a mass spectrometer, the mass spectrometer having a source of electrons with energy $E_1$ for producing sample ions by electron bombardment, the production of each sample ion coincidentally converting one electron of energy $E_1$ to an electron of energy $E_2$, each sample ion having a time of flight for transmitting through a mass filter, the apparatus comprising means for detecting a subset $I_0$ of the electrons having energy $E_2$, mean for counting the subset $I_0$ of electrons having energy $E_2$, said electron counting means being electronically coupled to said electron detection means, means for detecting sample ions which emanate from the mass filter, means for the time correlating a subset I of the sample ions detected by said ion detection means with the subset $I_0$ of electrons of energy $E_2$ detected by said electron detection means according to the time of flight of the sample ions for transmitting through the mass spectrometer, said time-correlation means being electronically coupled to both said electron detection means and ion detection means, and means for counting the subset I of sample ions, said ion counting means being electronically coupled to said time-correlation means, whereby the quotient of the count of the subset I of sample ions and the count of the subset $I_O$ of electrons of energy $E_2$ being substantially equivalent to the transmission efficiency of the mass spectrometer with respect to the sample ions.

2. Apparatus as recited in claim 1 wherein said electron detection means comprises an electron energy analyzer positioned in the path of the electrons of energy $E_2$ for transmitting the electrons of energy $E_2$ therethrough and for filtering out electrons having energies other than energy $E_2$, an electron detector positioned behind said electron energy analyzer for detecting the subset $I_0$ of electrons of energy $E_2$ which have been transmitted through said electron energy analyzer and for producing a pulse signal A for each electron having energy $E_2$, and an amplifier A connected to said electron detector for shaping and amplifying the pulse signals A received from said electron detector.

3. Apparatus as recited in claim 2 wherein said electron counting means comprises a pulse counter A connected to said amplifier A for counting the subset $I_0$ by counting the pulse signals A which have been shaped and amplified by said amplifier A.

4. Apparatus as recited in claim 3 wherein said ion counting means comprises an ion detector positioned in the path of the sample ions of mass M emanating from said mass filter for producing a pulse signal B for each sample ion of mass M which emanates from said mass spectrometer, an amplifier B connected to said ion detector for shaping and amplifying the pulse signal B from said ion detector, a time-to-pulse-height converter connected to both said amplifier A and said amplifier B, the pulse signal A from said amplifier A starting said time-to-pulse-height converter and the pulse signal B from said amplifier B stopping said time-to-pulse-height converter, said time-to-pulse-height converter segregating pulse signals B into a subset I of pulse signals B which are time correlated with the pulse signals A and a second subset of pulse signals B which are not time correlated with the subset $I_0$, and a pulse height analyzer connected to said time-to-pulse-height converter for counting the subset I of sample ions of mass M having pulse signals B which are time correlated with the pulse signals A of subset $I_0$.

5. Apparatus as recited in claim 4 wherein said ion counting means further comprises a variable time delay interposed between said amplifier A and said time-to-pulse-height converter for delaying the transmission of pulse signals A from said amplifier A to said time-to-pulse-height converter for preventing pile up of signal pulses B within said time-to-pulse-height converter.

6. A method for determining the transmission efficiency of a mass spectrometer with respect to sample ions of mass M comprising the steps of:

Step 1: ionizing sample material of mass M by bombardment with electrons having a substantially uniform energy $E_1$, the sample material of mass M having an energy of ionization less than the energy $E_1$, each ionization of the sample material coincidentally producing one electron having a substantially uniform energy $E_2$, where the energy $E_2$ equals the energy $E_1$ minus the energy of ionization of the sample material of mass M;

Step 2: counting a subset $I_0$ of the electrons of energy $E_2$ produced in said Step 1;

Step 3: transmitting the sample ions produced in said Step 1 through the mass spectrometer; and Step 4: detecting sample ions which have been transmitted through the mass spectrometer;

Step 5: time correlating a subset I of the sample ions of mass M detected in said Step 4 with the subset $I_0$ of electrons of energy $E_2$ counted in said Step 2;

Step 6: counting the subset I which was time correlated with the subset $I_0$ in said Step 5; then Step 7: calculating the quotient of the count of subset I of said Step 6 and the count of subset $I_0$ of said Step 2 for determining the transmission efficiency of the mass spectrometer with respect to sample ions of mass M.

7. An arrangement for calibrating the transmission efficiency of a mass filter with respect to the transmission of ionized sample molecules, the arrangement comprising a source for generating a sample beam composed of sample molecules, an electron gun for generating an electron beam composed of electrons having a substantially uniform energy $E(_1)$ for producing ionized sample molecules from the sample beam, the energy $E(_1)$ being greater than the energy of ionization of the sample molecules, said electron gun being positioned adjacent to said source and the electron beam having an orientation for colliding the electrons of energy $E(_1)$ with the sample molecules within the sample beam and transferring the energy of ionization from the electron of energy $E(_1)$ to the sample molecules for forming ionized sample molecules, each ionization of the sample molecules coincidentally resulting in the formation of one electron having substantially uniform energy $E(_2)$, where the energy $E(_2)$ equals the energy $E(_1)$ minus the energy of ionization of the sample molecules, a means for counting a subset $(I(_0))$ of the electrons of energy $E(_2)$, said electron counting means facing the electron beam of detecting the electrons of energy $E(_2)$, a mass filter for filtering the ionized sample molecules according to mass, an ion detection means for detecting the filtered ionized sample molecules, each filtered ionized sample molecule having a time of flight from the source to the ion detection means, and a means for counting a subset (I) of the filtered ionized sample molecules which have passed through the mass filter, the subset (I) being time-correlated with the subset ($I_{(0)}$) according to the time of flight of the filtered ionized sample molecules, said ion counting means being electronically connected to the ion detection means and to said electron counting means, whereby the quotient of the count of (I) and the count of ($I_{(0)}$) is substantially equivalent to the transmission efficiency of the mass spectrometer with respect to the ionized sample molecules.

8. An arrangement as recited in claim 7 wherein said electron counting means comprises an electron energy analyzer positioned in the path of the electrons of energy $E_{(2)}$ for transmitting the electrons of energy $E_{(2)}$ therethrough and for filtering out electrons having energies other than energy $E_{(2)}$, an electron detector positioned behind said electron energy analyzer for detecting the electrons of energy $E_{(2)}$ which have been transmitted through said electron energy analyzer and for producing a signal pulse (A) for each electron of energy $E_{(2)}$ of the subset ($I_{(0)}$), an amplifier (A) connected to said electron detector for shaping and amplifying the signal pulses (A) from said electron detector, and an electron pulse counter connected to said amplifier (A) for counting the subset ($I_{(0)}$) by counting the signal pulses (A) which have been shaped and amplified by said amplifier (A).

9. An arrangement as recited in claim 8 wherein the ion counting means of said ion detection means comprises an ion detector positioned in the path of the ionized sample molecules emanating from mass filter for producing a signal pulse (B) for each ionized sample molecule emanating from said mass filter, an amplifier (B) connected to said ion detector for shaping and amplifying the signal pulse (B) from said ion detector, a time-to-pulse-height converter connected to both said amplifier (A) and said amplfier (B), the signal pulse (A) from said amplifier (A) starting said time-to-pulse-height converter and the signal pulse (B) from said amplifier (B) stopping said time-to-pulse-height converter, said time-to-pulse-height converter segregating signal pulses (B) into a subset (I) of signal pulses (B) which are time correlated with the signal pulses (A) and a second subset of signal pulses which are not time correlated with the subset ($I_{(0)}$), and a pulse height analyzer connected to said time-to-pulse-height converter for recording the count of the subset (I) of ionized sample molecules having signal pulses (B) which are time correlated with the signal pulses (A) of subset ($I_{(0)}$).

10. An arrangement as recited in claim 8 wherein said ion counting means further comprises a variable time delay interposed between said amplifier (A) and said time-to-pulse-height converter for delaying the transmission of signal pulses $E_{(2)}$ from said amplifier (A) to said time-to-pulse-height converter for preventing pile-up of signal pulses (B) within said time-to-pulse-height converter.

* * * * *